US007790056B2

(12) United States Patent
Giering et al.

(10) Patent No.: US 7,790,056 B2
(45) Date of Patent: Sep. 7, 2010

(54) CODING SYSTEM FOR VALUE DOCUMENTS

(75) Inventors: Thomas Giering, Kirchseeon (DE); Gerhard Schwenk, Puchheim (DE)

(73) Assignee: Giesecke & Devrient GmbH, Munich (DE)

( * ) Notice: Subject to any disclaimer, the term of this patent is extended or adjusted under 35 U.S.C. 154(b) by 766 days.

(21) Appl. No.: 10/574,662

(22) PCT Filed: Oct. 5, 2004

(86) PCT No.: PCT/EP2004/011131

§ 371 (c)(1),
(2), (4) Date: Nov. 22, 2006

(87) PCT Pub. No.: WO2005/036478

PCT Pub. Date: Apr. 21, 2005

(65) Prior Publication Data

US 2007/0057072 A1 Mar. 15, 2007

(30) Foreign Application Priority Data

Oct. 8, 2003 (DE) ..... 103 46 685

(51) Int. Cl.
*G07D 7/12* (2006.01)

(52) U.S. Cl. ..... 252/301.16; 252/301.33; 252/301.34; 252/301.35; 252/301.36; 252/301.4 R; 252/301.5; 252/301.6 R; 252/301.6 P; 252/301.6 F; 252/301.6 S; 252/301.4 P; 252/301.4 F; 252/301.4 H; 252/301.4 S; 106/31.15; 106/31.64; 106/31.32; 283/92; 283/85

(58) Field of Classification Search ..... 252/301.16, 252/301.33–301.36, 301.4 R–301.6 F; 106/31.15, 106/31.64, 31.32; 283/92, 85
See application file for complete search history.

(56) References Cited

U.S. PATENT DOCUMENTS

| | | | | |
|---|---|---|---|---|
| 3,473,027 | A * | 10/1969 | Freeman et al. | 250/365 |
| 4,013,490 | A * | 3/1977 | Ryan et al. | 149/2 |
| 4,451,521 | A | 5/1984 | Kaule et al. | |
| 6,380,547 | B1 * | 4/2002 | Gonzalez et al. | 250/458.1 |
| 2004/0105962 | A1 * | 6/2004 | Giering et al. | 428/195.1 |

FOREIGN PATENT DOCUMENTS

| | | | |
|---|---|---|---|
| DE | 101 20 818 | | 10/2002 |
| EP | 0 052 624 | | 6/1982 |
| EP | 0 053 124 | | 6/1982 |
| EP | 0 659 935 | | 6/1995 |
| EP | 1 182 048 | | 2/2002 |
| WO | WO 01/48311 | | 7/2001 |
| WO | WO 02/070279 | * | 9/2002 |

OTHER PUBLICATIONS

Search report of China Patent Office regarding CN 2004/80029707X, Aug. 2008 with English Translation.

* cited by examiner

*Primary Examiner*—C. Melissa Koslow
(74) *Attorney, Agent, or Firm*—Bacon & Thomas, PLLC

(57) ABSTRACT

The invention relates to a composition for a coding forming at least part of a coding system having a luminescent basic substance and at least one luminescent additive, the composition of the coding being formed by the presence or absence of a luminescent additive and/or the type of additives and/or the number of additives.

24 Claims, 1 Drawing Sheet

CODING SYSTEM FOR VALUE DOCUMENTS

BACKGROUND OF THE INVENTION

A. Field

This invention relates to a composition for forming a coding for objects to be secured.

B. Related Art

To provide a readily machine-readable coding for a security paper it was proposed in the print WO 01/48311 to provide the security paper with at least two types of mottling fibers that differ with regard to their luminescent properties. Only one of the different mottling fibers is in each case located in defined, nonoverlapping partial areas of the security paper, so that the geometric arrangement of the partial areas and the presence or absence of mottling fibers permit a coding to be produced. However, the number of thus producible geometric arrangements is limited due to the very limited space available on a security paper.

On these premises, the invention is based on the problem of proposing a coding system that combines high falsification security with a large number of coding possibilities.

BRIEF SUMMARY OF THE INVENTION

According to the invention, a composition for forming a coding (at least one detectable or observable signal or character for communication), belonging to at least part of a coding system, has a luminescent basic substance and at least one luminescent additive, the possible codings of the coding system being formed by the presence or absence of a luminescent additive and/or the type of additives and/or the number of additives. The invention is based on the idea that the security aspect can be ensured by the luminescent basic substance, while a large number of codings is provided by the multiplicity of possible additives.

The basic substance can preferably be identified only by user groups making extremely high demands on the authenticity check, such as central banks. The additive can preferably also be identified by a user group carrying out a lower-quality security check, such as local train services, department stores, etc., and wishing to already identify the additive with simpler and less expensive detection apparatuses.

In a preferred embodiment, the luminescent basic substance and the luminescent additives each have coding-relevant emission lines located in a joint emission range. All coding-relevant emission lines are preferably outside the visible spectral range in order to impede the detectability of the emission. It has proved especially advantageous if all coding-relevant emission lines are in the spectral range from 750 nm to about 2500 nm, preferably in the spectral range from about 800 nm to about 2200 nm, particularly preferably in the spectral range from about 1000 nm to about 1700 nm. If a coding-relevant emission line is in the range above about 1000 nm, it is excluded from comparatively simple detection by commercially available silicon-based infrared detectors.

Preferably, the coding system contains at least two luminescent additives whose coding-relevant emission lines do not overlap with the coding-relevant emission lines of the basic substance, or are so remote spectrally from the coding-relevant emission lines of the basic substance that they can be easily distinguished by measuring technology.

The luminescent basic substance and/or at least one of the luminescent additives is preferably a luminescent substance based on a doped host lattice. Said luminescent substances can be excited e.g. by irradiating directly into the absorption bands of the luminescent ions and the latter thereupon emitting. In preferred variants it is also possible to use absorbent host lattices and so-called sensitizers which absorb the excitation radiation and transfer it to the luminescent ion which then itself emits with its characteristic wavelengths. Obviously, the host lattices and/or the dopants can be different in each case, in order to obtain different excitation and/or emission ranges for the luminescent substances.

In a preferred embodiment, the host lattice absorbs in the visible spectral range and optionally additionally in the near infrared range up to about 1.1 μm. Excitation can then be performed with high effectiveness by light sources, such as halogen lamps, flash lamps, LEDs, lasers or xenon arc lamps, so that only small amounts of the luminescent substance are required. The small amount of substance impedes detection of the used substance by potential forgers. If the host lattice absorbs in the near infra-red up to about 1100 nm, easily detectable emission lines of the dopant ions can be suppressed, leaving only the emission at larger wavelengths that is more elaborate to detect.

In an alternative preferred embodiment, luminescent substances are used that absorb even in the visible spectral range, preferably over most of the visible spectral range, particularly preferably into the near infrared range. Then, too, emissions in these more easily accessible spectral ranges are suppressed.

In an advantageous variant of the inventive coding, the luminescent basic substance and/or at least one of the luminescent additives is formed on the basis of a host lattice doped with rare earth elements. Dopants that can be used here are in particular neodymium, erbium, holmium, thulium, ytterbium, praseodymium, dysprosium or a combination of said elements.

According to another advantageous variant, the luminescent basic substance and/or at least one of the luminescent additives is formed on the basis of a host lattice doped with a chromophore, the chromophore being selected from the group of scandium, titanium, vanadium, chromium, manganese, iron, cobalt, nickel, copper and zinc. The dopants and host lattices stated in WO 02/070279 are also suitable for use as luminescent substances and in particular for use as the luminescent basic substance. At least one of the host lattices can be doped with a plurality of chromophores. Obviously, the two variants can be combined, i.e. one or some of the luminescent substances formed on the basis of a rare earth doped host lattice and other luminescent substances on the basis of a host lattice with a chromophore.

The host lattice can have for example a perovskite structure or a garnet structure. At least one of the host lattices can also be formed by a mixed crystal. Further possible embodiments of the host lattices and the dopants are specified in EP-B-0 052 624 or EP-B-0 053 124, whose disclosures are included in the present application in this respect.

According to an advantageous development of the invention, first and second luminescent additives which form a pair of mutually associated luminescent substances are provided in the coding system. The emission spectra of the first and second additives overlap in at least a subrange of the joint emission range such that the emission spectrum of the first additive is complemented by the emission spectrum of the second additive. The first and second additives are formed in particular by a doped host lattice of the above-described type. These measures provide a high-quality and high-security coding in which the spectral resolution of the mutually complementary luminescence emissions can only be obtained with great technical effort.

In a preferred embodiment, the first and second additives are formed on the basis of different host lattices which have crystal fields of different strength and which are each doped with the same dopant. The influence of the crystal field at the site of the dopant causes its electronic levels to be shifted relative to the undisturbed state. Since the amount of shift varies for the different levels, shifts result in the energy intervals of the electronic levels and thus also in the position of the emission lines, depending on the strength and symmetry of the crystal field. If the same dopant is selected for the first and second additives, small shifts of the associated emission lines relative to the undisturbed emission can be adjusted in controlled fashion by a suitable choice of host lattices with crystal fields of different strength.

The stated subrange where the luminescence spectra of the first and second additives complementarily overlap preferably has a width of 200 nm or less, preferably 100 nm or less. In a preferred embodiment, the subrange extends from about 850 nm to about 970 nm. In other, likewise advantageous embodiments, the subrange extends from about 920 nm to about 1060 nm, or from about 1040 nm to about 1140 nm, or from about 1100 nm to about 1400 nm, preferably from about 1100 nm to about 1250 nm, particularly preferably from about 1120 nm to about 1220 nm, or from about 1300 nm to about 1500 nm, or from about 1400 nm to about 1700 nm.

The first and second additives advantageously have in the stated subrange at least one emission line in each case whose positions have a distance apart of about 50 nm or less, preferably about 30 nm or less, particularly preferably about 20 nm or less, very particularly preferably about 10 nm or less. Such a small distance between the emission lines considerably impedes detection that two different luminescent additives are present. In preferred embodiments, the emission lines are narrowband and have in particular a half-width of about 50 nm or less, preferably about 30 nm or less, particularly preferably about 20 nm or less, very particularly preferably about 10 nm or less.

The coding system can also have a plurality of pairs of mutually associated additives which can each be formed as described. The pairs of additives are preferably coordinated with each other such that the subranges where the emission spectra of the two additives complementarily overlap are different for different pairs. It is also possible to provide further luminescent substances which likewise emit in one of the stated subranges of the spectrum and preferably further complement the emission spectrum of the pair of additives. By variations and combinations of the different dopants and host lattices it is thus possible to produce a multiplicity of pairs of additives or additive mixtures whose coding-relevant emission lines overlap complementarily in different spectral subranges in each case. This permits very compact codings to be formed which occupy little space on the object to be secured while having high information density.

The coding-relevant emission line of the luminescent basic substance is preferably in the infrared spectral range above 1100 nm. "Infrared spectral range" is understood according to the invention to be the wavelength range from 750 nm and more, preferably 800 nm and more. A plurality of luminescent basic substances can also be provided in the coding system, so that for example different user groups can use different basic substances for the authenticity check.

Objects to be secured may be in particular value documents, such as bank notes, shares, bonds, certificates, coupons, checks, high-quality admission tickets, credit cards, identity cards, passports and other identification documents, and security papers for producing such value documents. In particular, the coding system is suitable for securing value documents, such as bank notes.

At least one of the luminescent substances can be printed on the value document. A plurality of the luminescent substances, for example a pair of mutually associated luminescent substances, can also be printed on the value document jointly in a printing ink. The printing inks used for this purpose can be transparent or contain additional coloring pigments which must not impair detection of the luminescent substances. They preferably have transparent areas in the excitation range and the viewed emission range of the luminescent substances.

The value document preferably comprises a substrate which is formed by a printed or unprinted cotton fiber paper, a cotton/synthetic fiber paper, a cellulosic paper or a coated, printed or unprinted plastic film. A laminated multilayer substrate can also be used.

One or more of the luminescent substances can also be incorporated into the volume of the value document, in particular the value document substrate. Incorporating the luminescent substances into the volume of a paper substrate can be done for example by a method as described in the prints EP-A 0 659 935 and DE 101 20 818. The disclosures of the stated prints are included in the present application in this respect.

Alternatively, the luminescent substances can also be added randomly to the paper stock before sheet formation.

DESCRIPTION OF THE DRAWINGS

Further embodiments and advantages of the invention will be explained hereinafter with reference to the figures. For clarity's sake, the representation in the figures is not true to scale or to proportion.

The figures are described as follows.

DETAILED DESCRIPTION OF THE PREFERRED EMBODIMENTS OF THE INVENTION

Figure 1:
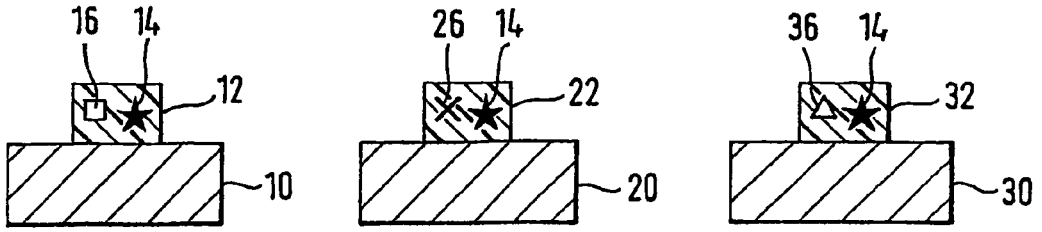
FIG. 1 a schematic representation of different secured objects, each with a coding according to an embodiment of the inventive coding system, FIG. 2 schematic emission patterns of a luminescent basic substance and three luminescent additives as can be used for the coding system of FIG. 1, FIG. 3 a schematic representation of a secured object provided with a coding according to another embodiment of the inventive coding system, and FIG. 4 schematic emission patterns of a luminescent basic substance and three luminescent additives as can be used for the coding system of FIG. 3.

To illustrate the invention, FIG. 1 shows three secured objects 10, 20 and 30 respectively provided with codings 12, 22 and 32 of an inventive coding system.

The coding system of FIG. 1 contains a high-quality and difficult-to-imitate luminescent basic substance 14 and three luminescent additives 16, 26 and 36. Both the basic substance and the additives show, after excitation, emissions in the infrared spectral range between 1000 nm and 1500 nm.

The basic substance can be formed for example by a luminescent substance according to WO 02/070279. As shown in the right-hand part of FIG. 2, its coding-relevant emission line 40 is located at about 1200 nm in this embodiment. The additives do not have to meet any high requirements with regard to imitability; they may be any substances luminescing in the stated spectral range. In the embodiment, the luminescent additives 16, 26 and 36 are formed on the basis of neodymium doped host lattices and have coding-relevant emission lines 42, 44 and 46 in the range around 1064 nm, as shown in the left-hand part of FIG. 2.

The additives 16, 26 and 36 are formed on the basis of different host lattices which produce crystal fields of different strength at the site of the neodymium ion. The interaction between the crystal field and the neodymium ions results, as explained above, in emission lines each slightly shifted relative to the undisturbed value, which makes the emissions of the additives mutually distinguishable. In the embodiment, the peak position of the emission line 42 of the first additive 16 is located at a wavelength of about 1065 nm, the peak position of the emission line 44 of the second additive 26 at about 1080 nm, and the peak position of the emission line 46 of the third additive 36 at about 1090 nm.

The codings 12, 22 and 32 allow both a high-quality authenticity check and a distinction of the different secured objects due to the coded information. Each of the codings 12, 22 and 32 contains the difficult-to-imitate basic substance 14 and one of the three additives 16, 26 and 36. If the basic substance 14 is detected by its characteristic luminescence emission 40 upon readout of a coding, the particular coding can be classified as authentic. The distinction of the different objects is then effected on the basis of the particular detected additive 16, 26 or 36. Since the authenticity of the coding is already guaranteed by the basic substance 14, the imitability of the additives is of minor importance in this embodiment.

The objects to be secured can be for example bank notes whose authenticity is checked with the help of the luminescent basic substance. The different luminescent additives can represent different denominations of the bank notes. Basic substance and additive are expediently distributed uniformly within the volume of the bank note substrate, in order to make the transfer of a coding to a bank note of another denomination recognizable.

Figure 3:
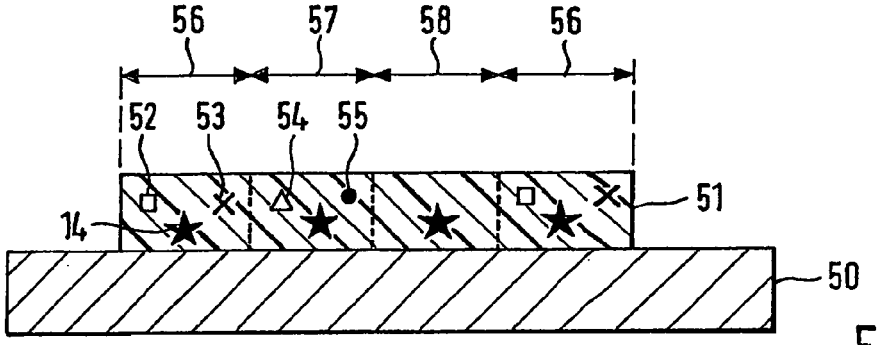

In the embodiment of FIG. 3, an object 50 to be secured is provided with a coding 51 according to another inventive coding system. The coding system of FIG. 3 contains, besides the above-described, difficult-to-imitate luminescent basic substance 14, two pairs of mutually associated luminescent additives 52, 53 and 54, 55 which, after excitation, show emissions in the infrared spectral range between 1000 and 1500 nm, and whose emission spectra overlap complementarily in paired fashion in a particular subrange of said spectral range, as described more closely hereinafter.

The arrangement of areas 56 with the first pair of additives 52, 53, areas 57 with the second pair of additives 54, 55 and areas 58 without additives along a given geometric pattern permits any information, for example a product code or the serial number of a bank note, to be represented by the coding 51.

The coding shown in FIG. 3 can be used to render for example a ternary code in which the state "0" is represented by an area without additives, the state "1" by an area with the first pair of additives 52, 53, and the state "2" by an area with the second pair of additives 54, 55. Detection of the coding 51 shown in FIG. 3 by a suitable detector would therefore recognize the ternary coding "1201".

The additives 52 and 53 are formed, like the above-described additives, on the basis of neodymium doped host lattices with crystal fields of different strength. As can be seen in the left-hand part of FIG. 4, the coding-relevant emission lines 62, 63 of the two additives 52, 53 overlap each other in the subrange from about 1000 nm to about 1150 nm such that the emission spectrum 62 of the first additive 52 is complemented by the emission spectrum 63 of the second additive 63. Due to the small distance between the two lines, the presence of the two additives 52 and 53 can practically not be recognized from the envelope emission curve without previous knowledge of the substances used.

Figure 4:
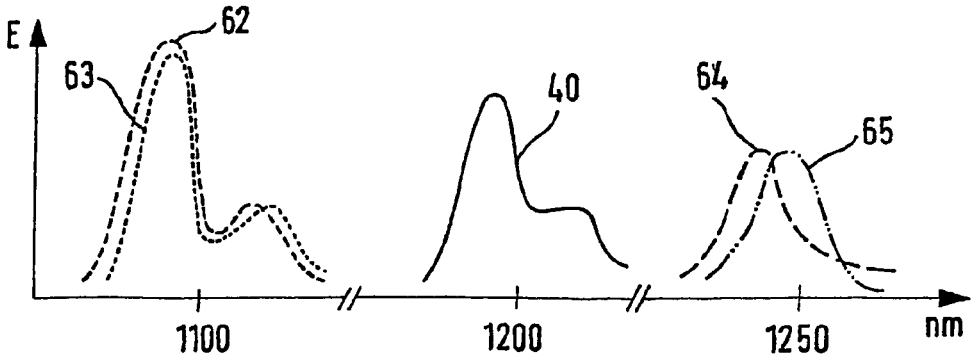

The right-hand part of FIG. 4 shows the emission patterns 64 and 65 of the additives 54 and 55 of the second pair of additives in the subrange around 1250 nm relevant for them. In this embodiment, the additives 54, 55 are each formed on the basis of a host lattice doped with a chromophore, the chromophore being selected from the group of scandium, titanium, vanadium, chromium, manganese, iron, cobalt, nickel, copper and zinc. As with the first pair of additives, it is practically impossible to derive the type of luminescent substances used from the envelope of the luminescence emissions of the two additives 54, 55 without further information.

Figure 2:
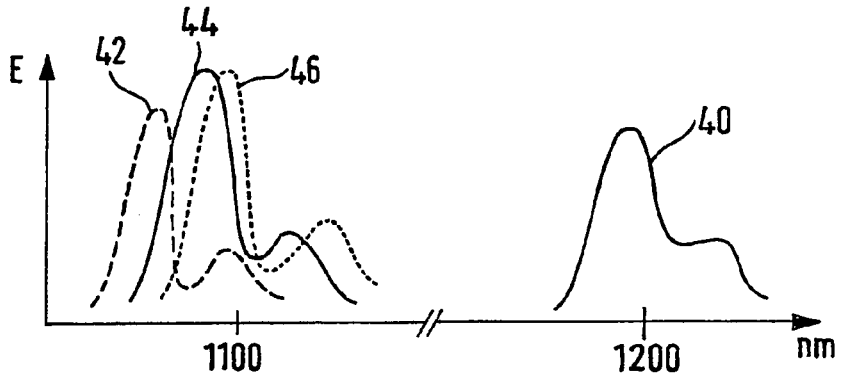

The coding system of FIGS. 2 and 4 permits a compact coding which combines the high falsification security provided by the difficult-to-imitate basic substance 14 with a high information density and small space requirement. Obviously, the use of further pairs of additives of the above-described type permits even denser codings.

The invention claimed is:

1. A composition for a coding forming at least part of a coding system for a value document, comprising: a luminescent basic substance and at least one luminescent additive;

wherein the luminescent basic substance and the luminescent additives each have coding-relevant emission lines located in a joint emission range; and first and second luminescent additives are provided which form a pair of mutually associated luminescent substances, the emission spectra of the first and second additives, which are so similar so as to be indistinguishable, overlapping in at least a subrange of the joint emission range.

2. The composition according to claim 1, wherein all coding-relevant emission lines are outside the visible spectral range.

3. The composition according to claim 1, wherein all coding-relevant emission lines are in the spectral range of from 750 nm to about 2500 nm.

4. The composition according to claim 1, wherein at least two luminescent additives are provided whose coding-relevant emission lines do not overlap with the coding-relevant emission lines of the basic substance in the joint emission range.

5. The composition according to claim 1, wherein at least one of the luminescent basic substance and at least one of the luminescent additives is formed on the basis of a doped host lattice.

6. The composition according to claim 1, wherein at least one of the luminescent basic substance and at least one of the luminescent additives is formed on the basis of a host lattice doped with rare earth elements.

7. The composition according to claim 1, wherein at least one of the luminescent basic substance and at least one of the luminescent additives is formed on the basis of a host lattice doped with a chromophore, the chromophore being selected from the group consisting of scandium, titanium, vanadium, chromium, manganese, iron, cobalt, nickel, copper and zinc.

8. The composition according to claim 7, wherein at least one of the host lattices is doped with a plurality of chromophores.

9. The composition according to claim 5, wherein at least one of the host lattices is formed by a mixed crystal.

10. The composition according to claim 1, wherein the first and second luminescent additives are formed on the basis of a doped host lattice.

11. The composition according to claim 1, wherein the first and the second luminescent additives are formed on the basis of different host lattices which have crystal fields of different strength and which are each doped with the same dopant.

12. The composition according to claim 1, wherein the stated subrange where the emission spectra of the first and second luminescent additives overlap has a width of 200 nm or less.

13. The composition according to claim 1, wherein the stated subrange where the emission spectra of the first and second luminescent additives overlap extends in a range selected from the group consisting of from about 850 nm to about 970 nm; from about 920 nm to about 1060 nm; from about 1040 nm to about 1140 nm; from about 1100 nm to about 1400 nm; from about 1100 nm to about 1250 nm; from about 1120 nm to about 1220 nm; from about 1300 nm to about 1500 nm; and from about 1400 nm to about 1700 nm.

14. The composition according to claim 1, wherein the first and second luminescent additives have in the stated subrange at least one emission line in each case whose positions have a distance apart of about 30 nm or less.

15. The composition according to claim 1, wherein the coding system composition has a plurality of pairs of mutually associated additives formed by providing a plurality of respective first and second luminescent additives, the emission spectra of the first and second additives overlapping in at least a subrange of the joint emission range.

16. The composition according to claim 15, wherein the subranges where the emission spectra of the first and second luminescent additives of a pair overlap each other are different for different pairs of mutually associated additives.

17. The composition according to claim 1, wherein the coding-relevant emission line of the luminescent basic substance is in the infrared spectral range above 1100 nm.

18. The composition according to claim 1, wherein a plurality of luminescent basic substances are provided.

19. A value document having a coding system formed by at least part of the coding composition according to claim 1.

20. The composition according to claim 6, wherein the host lattice is doped with one or more elements selected from the group consisting of neodymium, erbium, holmium, thulium, ytterbium, praseodymium, and dysprosium.

21. The composition according to claim 12, wherein the overlap has a width of 100 nm or less.

22. The composition according to claim 14, wherein said distance is 20 nm or less.

23. The composition according to claim 22, wherein the distance is 10 nm or less.

24. A composition for a coding forming at least part of a coding system for a value document, comprising: a luminescent basic substance and at least one luminescent additive;

wherein the luminescent basic substance and the luminescent additives each have coding-relevant emission lines located in a joint emission range; and first and second luminescent additives are provided which form a pair of mutually associated luminescent substances, the emission spectra of the first and second additives, which overlap each other so that the presence of the first and second luminescent additives can practically not be recognized.

* * * * *